United States Patent [19]

Enderlin

[11] Patent Number: 5,074,130

[45] Date of Patent: Dec. 24, 1991

[54] SEALING UNIT FOR AN INLET OR OUTLET OF A TEXTILE THREAD TREATMENT APPARATUS

[75] Inventor: Robert Enderlin, Morschwiller-le-Bas, France

[73] Assignee: Passap Knitting Machines Inc., Salt Lake City, Utah

[21] Appl. No.: 594,305

[22] Filed: Oct. 9, 1990

[30] Foreign Application Priority Data

Oct. 11, 1989 [FR] France ..... 89 13467

[51] Int. Cl.[5] ..... D06B 23/18

[52] U.S. Cl. ..... 68/5 E; 34/242

[58] Field of Search ..... 68/5 E, 258, 260; 34/242; 432/242; 277/27; 100/170

[56] References Cited

U.S. PATENT DOCUMENTS

| | | | |
|---|---|---|---|
| 814,124 | 3/1906 | Fish | 34/242 X |
| 1,829,684 | 10/1931 | Stansel | 432/242 X |
| 3,046,773 | 7/1962 | Healey | 68/5 E X |
| 3,291,468 | 12/1966 | Albertsen et al. | 432/242 X |
| 4,136,536 | 1/1979 | Gorodissky et al. | 68/5 E |
| 4,148,493 | 4/1979 | Gorodissky et al. | 68/5 E X |

*Primary Examiner*—Philip R. Coe

*Attorney, Agent, or Firm*—Davis, Bujold & Streck

[57] ABSTRACT

The invention concerns a sealing unit with rollers (7, 8) for the inlet (5) or the outlet of a treatment apparatus traversed by a conveyor belt (6) passing between the rollers, particularly an air and/or steam pressure apparatus. The sealing means between the frame (2) of the unit and the rollers are designed to be reliable, sturdy and easy to maintain. Specifically, they comprise an upper sealing device (29) and a lower sealing device (30), each one of which is in vertical contact with the corresponding roller (7, 8) and with a fixed element (27, 28). Each one of these devices may comprise a base plate (33) with a shaped slippery covering, consisting of a superficial strip (35) made of PTFE on a strip (34) of compressible flexible material. These devices may be removed without removing the rollers (7, 8). The contact means urging the sealing devices may have springs or hydraulic cylinders (31) or pneumatic cylinders.

24 Claims, 5 Drawing Sheets

SEALING UNIT FOR AN INLET OR OUTLET OF A TEXTILE THREAD TREATMENT APPARATUS

The present invention concerns a sealing unit for an inlet or outlet of an apparatus for pressure treating textile threads passing through said apparatus on a conveyor belt, said sealing unit comprising a frame, at least one upper roller and one lower roller transversely disposed in relation to the conveyor belt, respectively above and beneath said belt, and each having a cylindrical envelope of supple material, tightening means for pushing the rollers toward each other so as to clamp the conveyor belt between them, and sealing means for forming an impermeable seal between the rollers and the fixed elements of the frame.

Known sealing units, used especially at the inlet and outlet of treatment apparatus in which there may be a certain degree of air or steam pressure, have sealing elements usually consisting of supple rubber plates disposed along side the apparatus in relation to the rollers and with a lip which slides along the respective roller and contacts said roller by virtue of its own elasticity and the effect of the pressure within the apparatus. Sealing means of this type are described in U.S. Pat. No. 3,920,287. Plates such as these have different drawbacks. Because the flexible lip scrapes the roller, textile fibers or other particles from the threads deposited on the rollers tend to accumulate on these plates, thereby affecting sealing and eventually causing plate deterioration. Furthermore, these lips submitted to friction are delicate elements, so plates must be changed frequently. Replacement is difficult, as the plates are not readily accessible, and in many cases it necessitates removal of the rollers.

The goal of the present invention is to eliminate the disadvantages of the state of the art described above by providing a sealing unit with reliable, sturdy seals which are easily maintained and in particular, may be removed and replaced in the simplest possible manner.

To achieve this, the sealing unit according to the invention is characterized in that the sealing means comprises an upper sealing device and a lower sealing device which are slid onto the cylindrical envelope of the upper roller and that of the lower roller, respectively, tightly in contact with said rollers, said upper sealing device being situated above the upper roller and the said lower sealing device being situated beneath the lower roller, each of said sealing devices also being tightly in contact with one of the said fixed elements which are essentially parallel to the rollers, and retractable contact means being mounted on the frame to urge each of the sealing devices in a direction essentially perpendicular to the conveyor belt.

The sealing unit may comprise, on the side opposite the apparatus, an upper frontal opening across from the upper seal and a lower frontal opening across from the lower seal, said openings being provided for introducing or extracting the corresponding sealing device without removing the corresponding roller.

Preferably, each of the said sealing devices comprises a rigid base plate provided with a slippery covering in contact with the corresponding roller and a connecting element in contact with the fixed element.

The slippery covering may be in the form of a shaped strip inserted into a groove on the base plate. The said shaped strip preferably has a generally flat surface for sliding, facing the corresponding roller. The slippery covering may comprise a superficial strip made of material with a low coefficient of friction attached to a strip of flexible, compressible material.

In an especially simple, efficacious embodiment, the said seal connecting element comprises a portion made of synthetic material inserted into a groove in the base plate.

Preferably, the contact means are disposed to apply contact forces to the said base plate, the resultant of these forces passing between the said slippery covering and the said seal connecting element.

The contact means acting upon the sealing devices may comprise pneumatic or hydraulic cylinders. In a first embodiment, the contact means comprises several interconnected cylinders for each sealing device. In another embodiment, the contact means comprises a central pneumatic or hydraulic cylinder for each sealing device, coupled with the sealing device by a mechanism articulated so as to apply equal contacting forces at two spaced apart points on the said device.

In other instances, the contact means acting upon the sealing devices consists of springs rather than cylinders. These springs may be compression springs generally vertically disposed between the corresponding sealing device and a movable control device locked onto the frame. Each control device may be attached so that it rotates partially around a horizontal axis and may be associated with a manual control lever.

The roller tightening means may advantageously comprise tightening springs interposed between the bearing cases of one of the rollers and mechanical control means for said springs. In another form, they may comprise at least one pair of pneumatic or hydraulic cylinders attached to the frame and acting upon the bearing cases of one of the rollers.

A preferred form of embodiment provides that in the area of each of the two roller extremities, the frame has a pair of vertical guides between which there are mounted two bearing cases holding the rollers, and that the guide situated on the side opposite the apparatus, called the frontal side, is disposed on a detachable clamp, in such a way that the rollers may be extracted on the frontal side of the sealing unit after removal of said clamps. Preferably, the said frontal openings are situated between the two detachable clamps.

In a particular embodiment, the said clamps may be detached by rotation around a horizontal axis and have an open position in which their guides are essentially horizontal and form a support for the rollers removed from the sealing unit.

An advantageous perfected embodiment of a sealing unit according to the invention consists of the sealing means comprising two lateral sealing plates, each of which contacts at least one fixed element mounted on the frame, and contacts a respective extremity surface of the upper sealing device, of the upper roller, of the lower sealing device and of the lower roller. Each lateral plate preferably is vertically supported by support means of adjustable height on which it can slide in any horizontal direction, said plate being elastically urged by lateral contact means maintaining it in contact with the said fixed element and with the said extremity surfaces. The lateral contact means may consist of at least one contact means acted upon by a pneumatic or hydraulic cylinder and contacting the plate on a surface which is oblique in relation to the said extremity surfaces, so that the plate is simultaneously in contact with both those surfaces and with a perpendicular surface of the frame.

One form of embodiment which is particularly advantageous from the maintenance point of view provides that each lateral plate be movable and in contact with the said fixed element on the frame only along a connecting seal attached to the plate.

Other advantageous characteristics of the present invention will become apparent in the following description of some exemplary embodiments, with reference to the attached drawings, in which.

Figure 1:
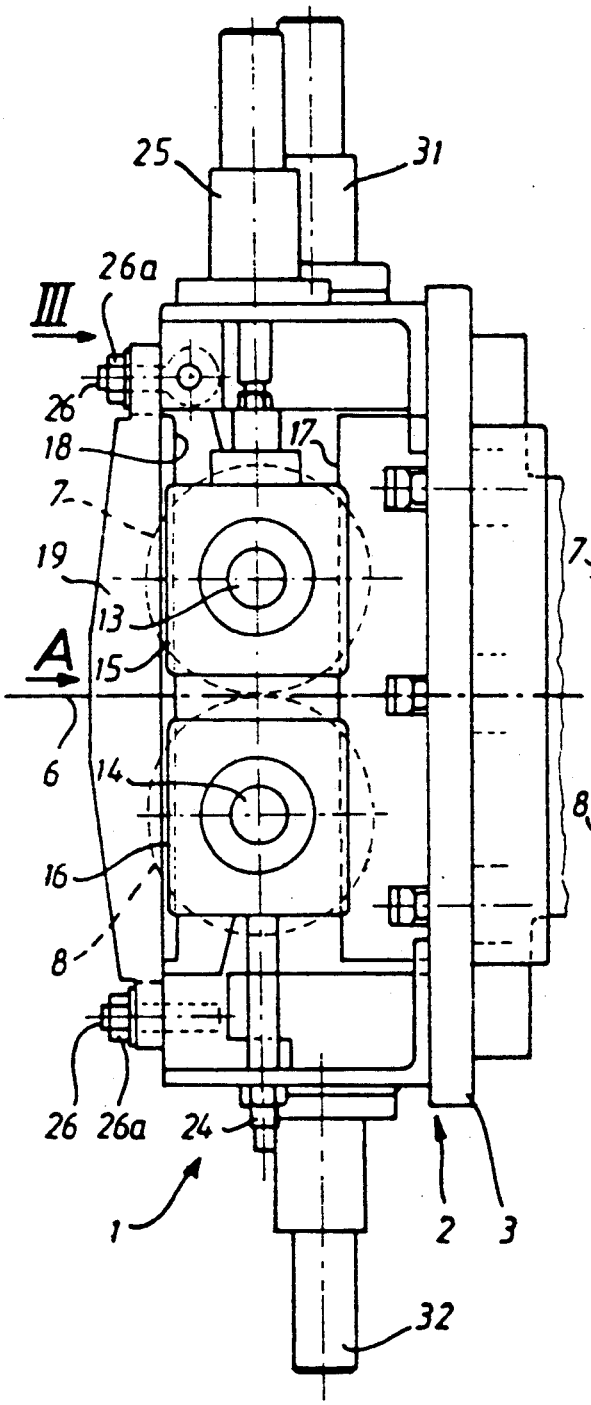
FIG. 1 is a lateral elevational view of a first form of embodiment of a sealing unit according to the invention.

In the form of embodiment shown in FIGS. 1 through 6, a sealing unit 1 according to the invention comprises a rigid frame 2 provided with a vertical base plate 3 tightly attached to a clamp 4 which in this instance surrounds an inlet opening 5 of a textile thread heat treatment apparatus using pressurized steam. The threads to be treated, generally in the form of spirals, are continuously deposited on a generally horizontal perforated metallic conveyor belt 6 moving in the direction of arrow A and successively passing through the sealing unit 1, the inlet opening 5 of the apparatus, the apparatus itself, then an outlet opening having a sealing unit similar to unit 1. Belt 6 and the threads it carries pass freely through inlet opening 5, which is impermeably sealed from the exterior of the apparatus by sealing unit 1. In known manner, the latter comprises an upper roller 7 and a lower roller 8 disposed one above the other, on one side and the other of belt 6, and which roll without sliding upon the belt or the threads it carries. Each roller 7, 8 comprises a thin envelope 9, 10 made of compressible material such as rubber and a rigid tube 11, 12 with rotatable end spindles 13, 14 held by support cases 15, 16 attached to vertical lateral guides 17, 18 of frame 2. Lower roller 8 is caused to rotate at a speed corresponding to the speed at which belt 6 advances by means of a mechanism partially visible in FIG. 3. Spindle 14 of lower roller 8 has a toothed gear 20 with a chain, driven by a motor, and a pinion 21 engaging a pinion 22 of the same diameter attached to spindle 13 of the upper roller. Upper roller 7 is caused to rotate by friction, while pinions 21 and 22 merely ensure synchronization of the roller speeds.

For determining the level of lower roller 8, a bolt 24 engaged in a threaded bore of frame 2 acts as a regulable vertical block for bearing 16 at each extremity of the roller. As for upper roller 7, it presses against belt 6 in the direction of the lower roller under the influence of a pair of pneumatic or preferably hydraulic cylinders 25 acting vertically upon bearings 15. A tightening device of this type is described in more detail in French Patent Application No. 2 629 106 of the same applicant.

Each of the two guides 18 situated on the frontal side of the unit, that is on the side opposite the apparatus, is supported by a vertical clamp 19 removably attached to the frame, for example by bolt 26 and screws 26a. Because of this construction, removal of clamps 19 allows each of the rollers 7, 8 with their respective bearing cases 15, 16 to be removed directly. In an advantageous embodiment (not shown), it is possible to pivotably mount each clamp 19 around a horizontal axis near its lower extremity so that the clamp may be lowered to a horizontal position in which it can support lower roller 8 extracted from the unit, and even upper roller 7 if belt 6 has been removed.

Opposite each roller 7, 8 frame 2 has a fixed horizontal element 27, 28 forming a sort of raised edge in the direction of the respective roller. Impermeability between rollers 7, 8 and these fixed elements 27, 28 is ensured by an upper sealing device 29 and a lower sealing device 30, each of which is held in contact with the roller and the corresponding fixed element by means of a respective arrangement of vertically acting hydraulic cylinders 31, 32.

Figure 2:
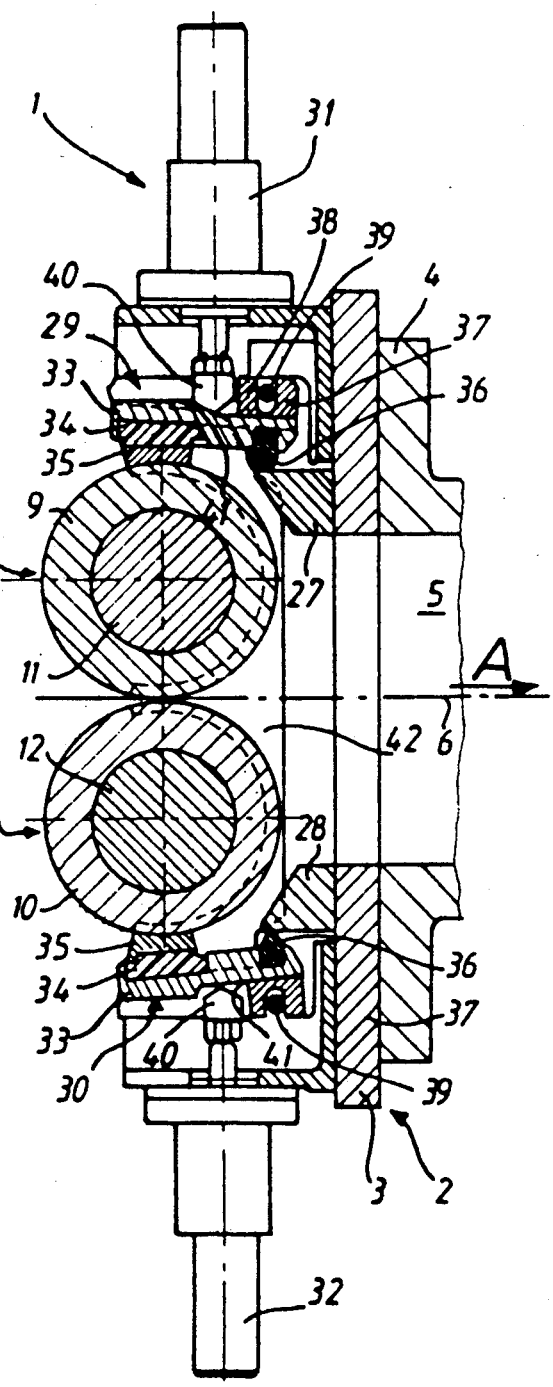
FIG. 2 is a vertical cross-section of said unit taken along line II—II of FIG. 3.
Figure 3:
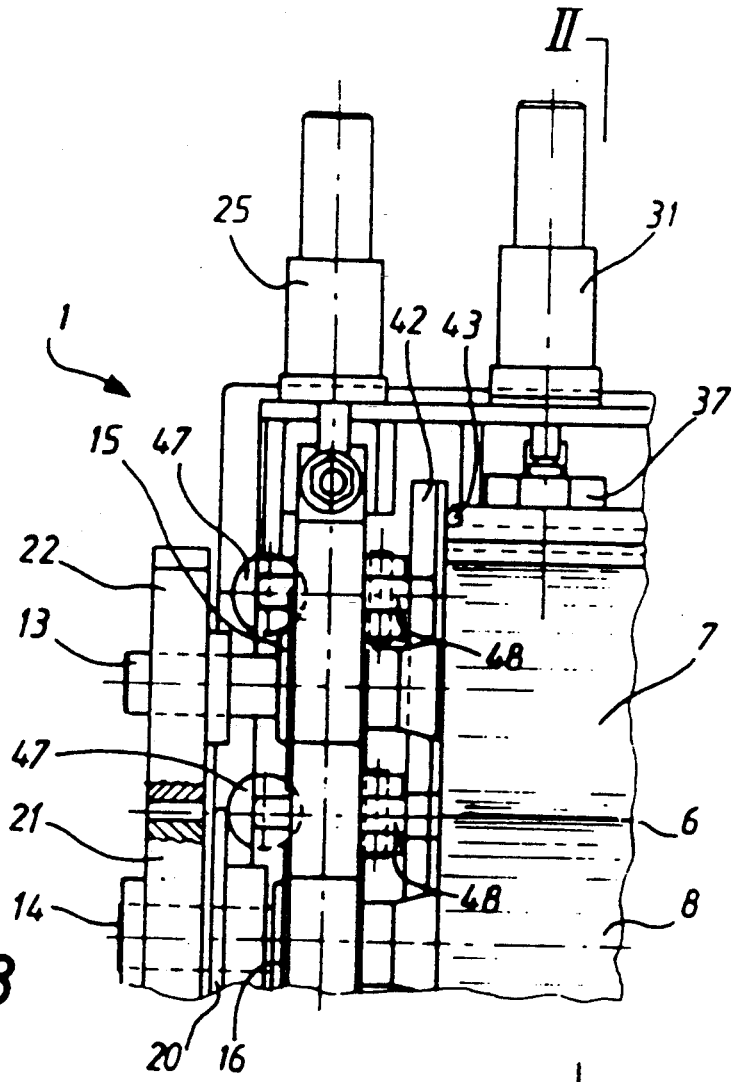
FIG. 3 is a partial frontal view according to arrow III of FIG. 1.
Figure 4:
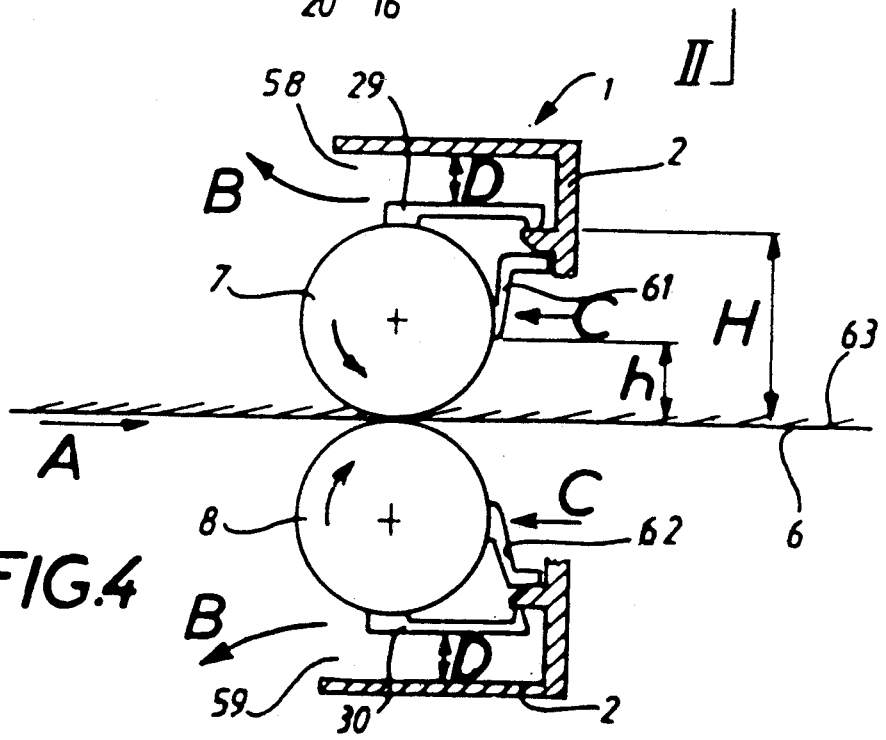
FIG. 4 is a schematic view analogous to FIG. 2 and shows certain advantages of the invention in relation to the prior art.

As is more particularly shown in FIG. 2, each sealing device 29, 30 comprises a metallic base plate 33 approximately horizontally disposed and extending along the entire length of the corresponding roller. Across from rollers 7, 8 each plate has a first groove to which a slippery covering in the form of a shaped strip is attached, comprising a base strip 34 of compressible material, for example pliable rubber, and a superficial strip 35 made of material with a low coefficient of friction, for example, polytetrafluoroethylene. This slippery strip is flat or slightly curved and is applied in a vertical direction to the corresponding roller 7, 8, that is, along a generatrix diametrically opposed to the line of contact between the rollers and the conveyor belt 6. Each base plate 33 also has a second groove located on the same side and parallel to the first, in which a connecting element 36 made of synthetic material is mounted, in vertical contact with a horizontal surface of corresponding fixed element 27, 28. On the side opposite this connecting element, base plate 33 is provided with at least two guide blocks 37 with a vertical notch 38 engaging a small cylindrical bar 39 attached to the frame. In this way, each sealing device 29, 30 is correctly guided and cannot be displaced by rotation of the roller, but has the benefit of a certain amount of play in the vertical direction and in the direction of the length of the roller.

Figure 7:
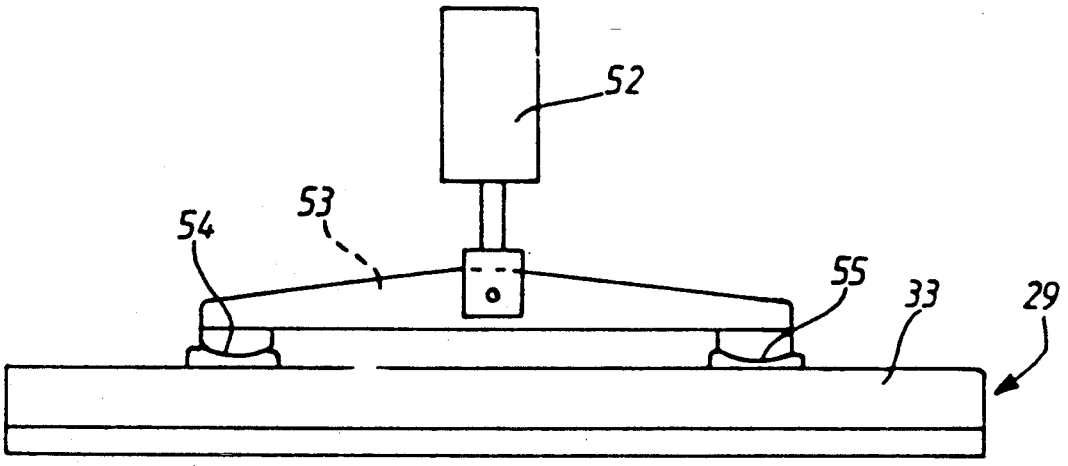
FIG. 7 is a frontal schematic view showing a variation of an embodiment of a hydraulic cylinder contact means.

In this example, each sealing device 29, 30 is pushed vertically by an arrangement of parallel cylinders 31, 32, each with a rounded head 40 abutting a corresponding bushing 41 attached to base plate 33. All the cylinders in the arrangement are hydraulically interconnected so as to exert equal forces along the sealing device. In another form of embodiment, shown schematically in FIG. 7, each arrangement of cylinders 31, 32 is replaced by a central cylinder 52 attacking a mechanism articulated to a balance 53 with two equal beams exerting vertical pushing forces upon base plate 33 at two points 54 and 55 spaced apart from each other. In another instance, pneumatic cylinders could be provided in place of hydraulic cylinders 31, 32 or 52.

In the construction described above, it should be noted that the contact forces exerted by cylinders 31, 32 or 52 on the respective sealing device 29, 30 are exerted in a vertical plane passing between connection 36 and sealing covering 34, 35, thereby automatically maintaining an impermeable contact between sealing device 29, 30 on the one hand, roller 7, 8 and fixed element 27, 28 on the other hand. The cylinders are preferably two-way cylinders, so that head 40 may easily be retracted for extraction of corresponding sealing device 29, 20 by pivoting it around small bars 39, then removing it from the sealing unit without dismantling any other piece. Thus, periodic control and maintenance of the sealing coverings, the rollers and the other elements of the sealing unit are considerably facilitated.

Figure 8:
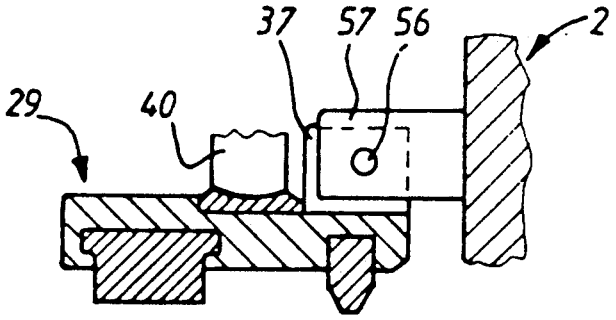
FIG. 8 shows a variation of the attachment of a sealing device shown in FIG. 2.

FIG. 8 is a schematic representation of a variation in the attachment of upper sealing device 29 to be connected to frame 2. In this case, instead of being slidably attached, guide block 37 is provided with a horizontal opening into which there is inserted a peg 56 also passing through corresponding openings in two fixed elements 57 situated on one side and the other of block 37. Several blocks 37 can be spaced along device 29; it can be easily removed from the sealing unit after removal of pins 56. The advantages of the arrangement of sealing devices 29 and 30 as described above will become apparent in the schema of FIG. 4. Since these devices are respectively above and below corresponding rollers 7, 8, each of them is opposite a corresponding frontal opening 58, 59 through which it can be extracted from sealing unit 1 in the direction indicated by arrows B. The presence of these frontal openings also facilitates monitoring the cleanliness and condition of the sealing covers, which may be cleaned by raising them slightly.

In contrast, prior art sealing devices, shown schematically by broken lines and bearing reference numerals 61 and 62, were placed between the pressurized enclosure and corresponding rollers 7, 8, that is, they could neither be controlled nor removed from the seal without removing the rollers. Furthermore, upper sealing device 61 was situated at a short distance h from thread spirals 63 upon conveyor belt 6. Therefore, there was considerable risk of the textile material, adhering to roller 7, being pushed toward sealing device 61 and remaining stuck there. In the embodiment of the present invention, upper sealing device 29 is situated at a relatively long distance H from the threads carried by belt 6 and therefore, there is less risk of the textile material reaching it.

Another disadvantage of the prior art sealing devices 61, 62 was that, because of their position, it was necessary to rely primarily on the pressure within the apparatus to apply them to the corresponding rollers, as shown by arrows C. This did not permit contact pressure upon the sealing covers to be freely controlled.

With the arrangement of sealing devices 29 and 30 according to the invention, the contact points and the entire area necessary to exert contact forces on these devices are disposed on frame 2, as shown by arrows D. The corresponding contact means, specifically cylinders 31, 32 described above, are easily located between the tightening means provided at the roller extremities, specifically cylinders 25. Impermeability between frame 2 and the extremity surfaces of rollers 7, 8 is assured by two lateral sealing plates 42 extending between the extremities of the upper sealing device 29 and the lower sealing device 30 which contact a compressible connector 43 (FIG. 3) attached along each extremity of these devices.

Figure 5:
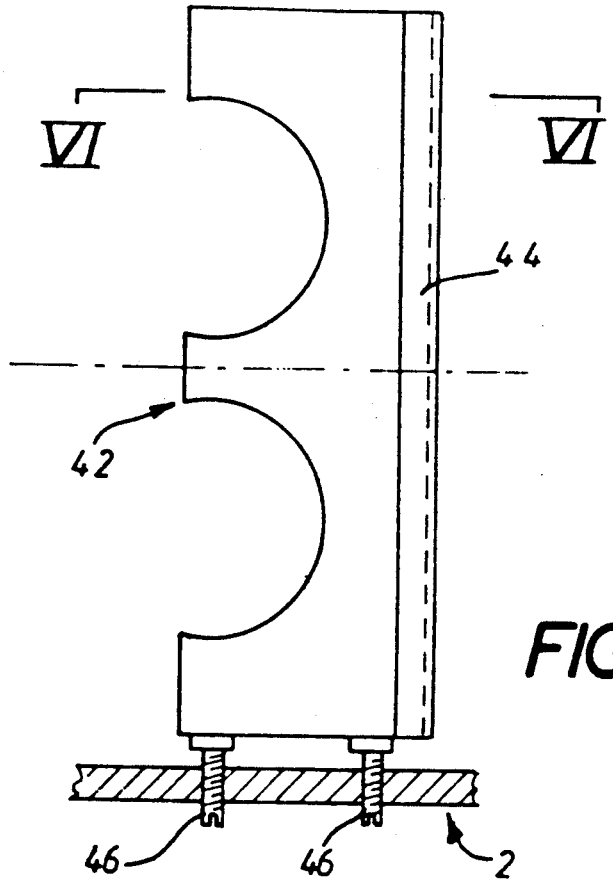
FIG. 5 is a schematic elevational view of a lateral sealing plate in a plane parallel to those of FIGS. 1 and 2.
Figure 6:
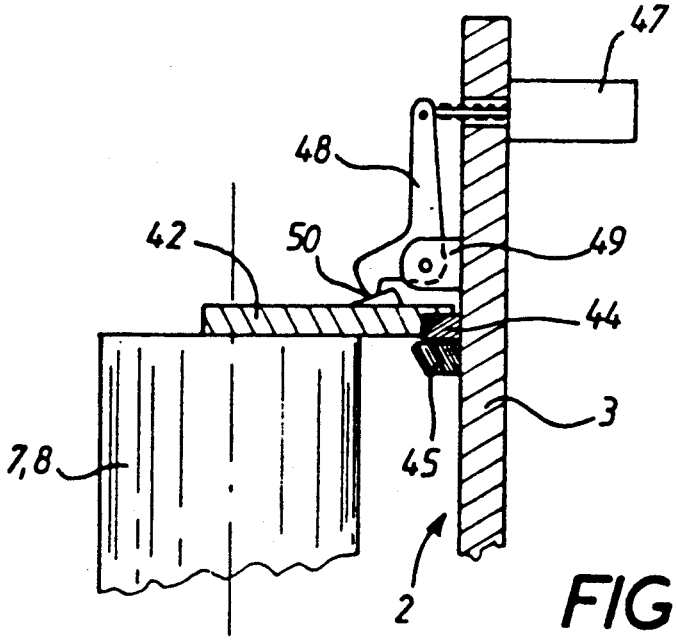
FIG. 6 is a horizontal cross-sectional view taken along line VI—VI of FIG. 5.

FIGS. 5 and 6 are a schematic representation of one of the lateral plates 42 which may comprise, for example, a plate made of rigid synthetic material or a metallic plate covered with polytetrafluoroethylene so that the extremities of rollers 7, 8 slide easily along it. On the side of frame base plate 3, plate 42 has a rectilinear edge to which there is attached a flexible connector 44 which is in continuous contact along a fixed element 45 of the frame. Plate 42 rests upon two screws 46 attached to frame 2 for adjusting its level. In addition, plate 42 is horizontally elastically pushed against fixed element 45 and against the extremities of rollers 7 and 8 by a mechanism comprising, in this example, three horizontal pneumatic or hydraulic cylinders 47 which push the plate by means of respective angled connecting rods 48 pivotably mounted on supports 49 attached to the frame. Each connecting rod 48 abuts an oblique surface 50 disposed on plate 42, thereby maintaining the plate in position by contacting its joint 44 with two perpendicular surfaces on element 45 and on plate 3 of the frame. Because of this arrangement, lateral plates 42 may be easily removed by activating two-way cylinders 47 and freeing the plates.

Although the preceding description mentions the use of pneumatic or hydraulic cylinders as the tightening means for the rollers as well as the contact means for the sealing devices, these cylinders could be replaced by other means in a sealing unit according to the invention. For example in FIG. 9, an embodiment of such a device is shown wherein tightening cylinders 25 described above are replaced by a mechanism with dual vertical springs 66 pressing down upon the bearing cases 15 of upper roller 7. The upper extremities of springs 66 pass through corresponding holes disposed in a frame 67 of the unit and are contacted by a movable control device 68, attached in such a way that it rotates partially around a horizontal axis 69 when manual control lever 70 is acted upon as shown by double arrow E. Movable device 68 is locked into its lower position where it compresses springs 66 with appropriate locking means, for example horizontal pegs 71. In addition, the pressure exerted upon each spring 66 may be regulated by a block with screws 72.

Figure 10:
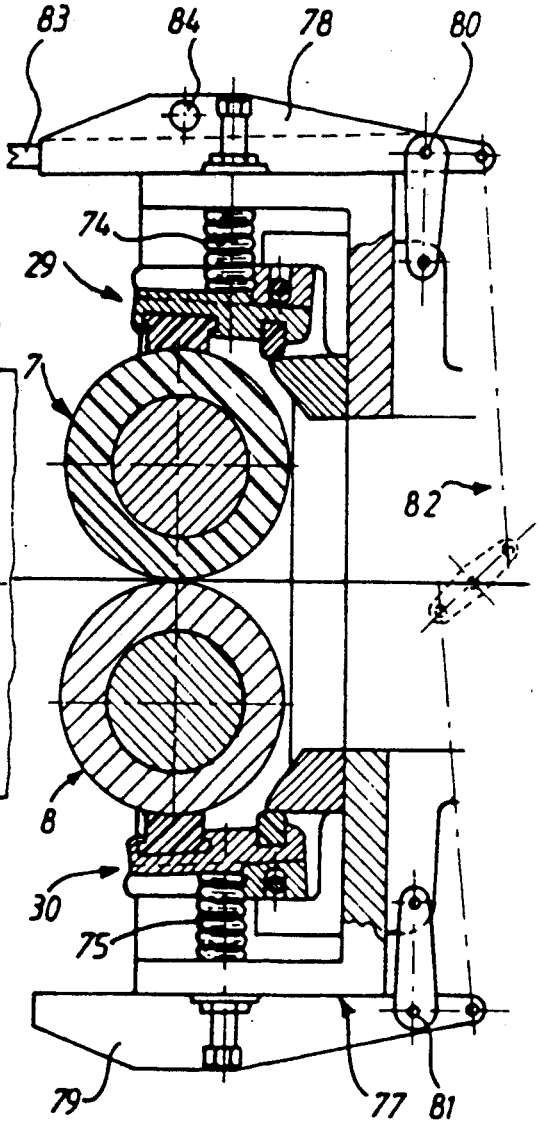

FIG. 10 is a schematic representation of an embodiment wherein upper sealing devices 29 and lower sealing devices 30 contact respective rollers 7, 8 by means of an arrangement of springs 74, 75 taking the place of contact cylinders 31, 32. At the end opposite the sealing device, springs 74, 75 pass through corresponding openings disposed in a suitable frame 77 and respectively abut an upper movable mechanism 78 and a lower movable mechanism 79. These two mechanisms rock on horizontal axes 80, 81 and are connected by a bracket 82, shown schematically, so that lower mechanism 79 follows symmetrically the movements of upper mechanism 78 activated by means of a manual lever 83 and locked in position for controlling the springs by appropriate devices such as horizontal pins 84.

Figure 9:
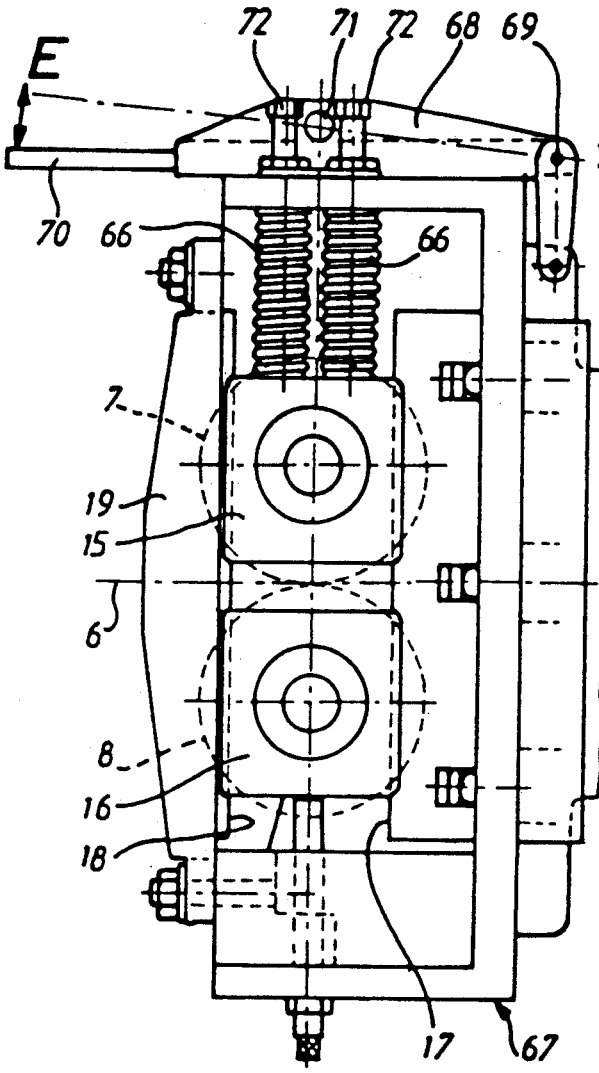
FIGS. 9 and 10 are views analogous to FIGS. 1 and 2 and show other forms of embodiments of a sealing unit according to the invention.

It should be noted that the spring devices shown in FIGS. 9 and 10 may be used together in the same sealing unit, but may also be combined with cylinders. For example, a sealing unit equipped with spring tightening devices according to FIG. 9 could also have sealing devices such as 29 and 30 urged by contact cylinders 31 and 32, of the type shown in FIGS. 1 through 3. Conversely, a sealing unit with cylinder tightening means 25 such as those shown in FIGS. 1 through 3 may have sealing devices 29, 30 with a spring contact mechanism such as that shown in FIG. 10. Furthermore, it should be noted that upper and lower sealing devices 29 and 30 may generally be installed on prior art sealing units with few structural modifications to the unit.

The present invention is not limited to the exemplary embodiments described above, but is applicable to any modification or variation obvious to one skilled in the trade.

I claim:

1. Sealing unit for the inlet or outlet of a pressure treatment apparatus for textile threads on a conveyor belt passing through said apparatus, comprising a frame (2), at least one upper roller (7) and one lower roller (8) which are transversely disposed in relation to the conveyor belt (6), respectively above and below said belt, and each having a cylindrical envelope (9, 10) made of supple material, tightening means urging the rollers toward each other so as to grip the conveyor belt between them, and sealing means to ensure an impermeable connection between the rollers and fixed elements (27, 28) of the frame, wherein the sealing means comprises an upper sealing device (29) and a lower sealing device (30), which are respectively slidably and firmly attached to the cylindrical envelope of the upper roller (7) and that of the lower roller (8), said upper sealing device (29) being situated above the upper roller (7) and said lower sealing device (30) being situated below the lower roller (8), each of said sealing devices (29, 30) also being in tight contact with one of the said fixed elements (27, 28) which are essentially parallel to the rollers, and retractable contact means (31, 32, 74, 75) being attached to the frame to urge each one of the sealing devices (29, 30) in a direction essentially perpendicular to the conveyor belt (6).

2. Sealing unit according to claim 1 comprising, an upper frontal opening (58) adjacent the upper sealing device (29) and a lower frontal opening (59) adjacent the lower sealing device (30), said openings being disposed to allow the corresponding sealing device to be introduced and extracted, through the corresponding frontal opening, without removing the corresponding roller.

3. Sealing unit according to claim 2 wherein the said frontal openings (58, 59) are located between two movable clamps (19).

4. Sealing unit according to claim 1, wherein each of the sealing devices comprises a rigid base plate (33) having a slippery covering (34, 35) in contact with the corresponding roller and a connecting element (36) in contact with the fixed element.

5. Sealing unit according to claim 4, in which the slippery covering (34, 35) is in the form of a shaped strip inserted into a groove in the base plate (33).

6. Sealing unit according to claim 5, wherein the said shaped strip comprises a generally flat slippery surface facing the corresponding roller.

7. Sealing unit according to claim 5, wherein the shaped strip comprises a superficial strip (35) made of material with a low coefficient of friction, attached to a strip (34) of compressible flexible material.

8. Sealing unit according to claim 4, wherein the said connecting element comprises a shaped piece of synthetic material (36), inserted into a groove in the base plate (33).

9. Sealing unit according to claim 4, wherein the contact means (31, 32, 74, 75) are disposed to apply contact forces to the said base plate (33), the resultant of these forces passing between the said slippery covering and the said connecting element of the sealing device.

10. Sealing unit according to claim 9, wherein the contact means comprises, for each sealing device (29, 30) several interconnected cylinders (31, 32).

11. Sealing unit according to claim 9, wherein the contact means comprises, for each sealing device (29, 30) a central pneumatic or hydraulic cylinder (52), connected to the sealing device by a mechanism articulated so as to apply equal contact forces to two points (54, 55) spaced apart from each other on the said device.

12. Sealing unit according to claim 1, wherein the contact means comprises pneumatic or hydraulic cylinders (31, 32).

13. Sealing unit according to claim 12, wherein the means for tightening the rollers comprises tightening springs (66), interposed between bearing cases (15) of one of the rollers, and mechanical means (68, 70) for controlling said springs.

14. Sealing unit according to claim 12, wherein the means for tightening the rollers comprises at least one pair of pneumatic or hydraulic cylinders (25) attached to the frame and acting upon bearing cases (15) of one of the rollers.

15. Sealing unit according to claim 1, wherein the said contact means comprises compression springs (74, 75) essentially vertically disposed between the corresponding sealing device and a movable control mechanism (78, 79) which can be locked to the frame.

16. Sealing unit according to claim 15, wherein each control mechanism (78, 79) is attached so that it can rotate partially around a horizontal axis (80, 81) and is attached to a manual control lever (83).

17. Sealing unit according to claim 15, wherein the means for tightening the rollers comprises tightening springs (66) interposed between bearing cases (15) of one of the rollers and mechanical means (68, 70) for controlling said springs.

18. Sealing unit according to claim 15, wherein the means for tightening the rollers comprises at least one pair of pneumatic or hydraulic cylinders (25) attached to the frame and acting upon bearing cases (15) of one of the rollers.

19. Sealing unit according to claim 1, wherein the frame (2) comprises, in the area of each of the two roller extremities, a pair of vertical guides (17, 18) between which two bearing cases (15, 16) supporting the rollers are attached, and in which the guide (18) is disposed on movable clamps (19) so that the rollers may be extracted from the sealing unit after removal of said clamps (19).

20. Sealing unit according to claim 19, wherein the said clamps (19) are movable by partial rotation around a horizontal axis and have an open position in which their guides are essentially horizontal and form a support for the rollers extracted from the unit.

21. Sealing unit according to claim 1, wherein the sealing means comprises two lateral sealing plates (42), each one of which abuts at least one fixed element (45) attached to the frame and abuts a respective extremity surface of the upper sealing device (29), of the upper roller (7) and of the lower sealing device (30) of the lower roller (8).

22. Sealing unit according to claim 21, wherein each lateral plate (42) is vertically supported by support means (46) of adjustable height on which the plate can slide in any horizontal direction, said plate being flexibly urged by lateral contact means (47, 48) which maintain it in contact with the said fixed element and with the said extremity surfaces.

23. Sealing unit according to claim 22, wherein the lateral contact means comprises at least one contact device (48) urged by a pneumatic or hydraulic cylinder (47) and abutting plate (42) on a surface (50) obliquely disposed in relation to the said extremity surfaces so as to contact the plate with those surfaces as well as with a perpendicular surface of the frame (2).

24. Sealing unit according to claim 21, wherein each lateral plate (42) is movable and is in contact with the said fixed element (45) of the frame only along a connecting seal (44) affixed to the plate.

* * * * *